US006340259B2

(12) United States Patent
Mito et al.

(10) Patent No.: US 6,340,259 B2
(45) Date of Patent: Jan. 22, 2002

(54) DIRECT-FEED TYPE WRITING IMPLEMENT

(75) Inventors: Yosuke Mito, Yokohama; Kazuhiko Furukawa, Kanagawa, both of (JP)

(73) Assignee: Mitsubishi Pencil Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/738,938

(22) Filed: Dec. 15, 2000

(30) Foreign Application Priority Data

Dec. 16, 1999 (JP) ..... 11-357279

(51) Int. Cl.[7] ..... B43K 5/18

(52) U.S. Cl. ..... 401/198; 401/223; 401/225; 401/227; 401/229; 401/230

(58) Field of Search ..... 401/198, 204, 401/205, 219, 223, 224, 225, 227, 229, 230, 237, 242

(56) References Cited

U.S. PATENT DOCUMENTS 2,921,558 A * 1/1960 Von Platen ..... 401/224
3,951,555 A * 4/1976 Wittnebert et al. ..... 401/199 X
4,509,876 A * 4/1985 Hori ..... 401/225 X
5,906,446 A * 5/1999 McCulloch et al. .... 401/198 X
5,951,187 A * 9/1999 Hsich ..... 401/227 X

FOREIGN PATENT DOCUMENTS

JP 36293 8/1992
JP 45914 10/1992

* cited by examiner

*Primary Examiner*—Gregory L. Huson
*Assistant Examiner*—Kathleen J. Prunner
(74) *Attorney, Agent, or Firm*—Darby & Darby

(57) ABSTRACT

A direct-feed type writing implement includes: a point assembly having a writing point at the tip thereof; an ink tank directly storing a relatively low viscosity ink having a viscosity of 2 to 100 mPa·S at room temperature; an ink collector for adjusting the internal pressure in the ink tank by utilizing capillarity; a feeder including a center core, for feeding ink from the ink tank to the writing point; a duct pipe connecting the ink collector and the ink tank; and a duct pipe ink storage portion provided for the duct pipe. In another embodiment, ink is supplied to the center core as the ink feeder only through the duct pipe.

22 Claims, 11 Drawing Sheets

DIRECT-FEED TYPE WRITING IMPLEMENT

BACKGROUND OF THE INVENTION (1) Field of the Invention

The present invention relates to a direct-feed type writing implement.

(2) Description of the Prior Art

Conventional direct-feed type writing implements which use so-called raw ink, i.e., liquid ink are known to employ an ink collector making use of capillary action, e.g., of a vane-like regulator or a fiber bundle for temporal retention of ink, in order to prevent ink leakage due to expansion of the air inside the ink tank accompanying change in ambient conditions such as reduction in pressure and/or increase in temperature.

In a writing implement using the ink collector, in order to positively prevent forward leakage of ink from the writing point side, the size of the ink collector is designed based on the maximum expansion, estimated from the ink tank volume. Therefore, the design of the size of the ink collector depends on the size of the ink tank. That is, the larger the ink tank, the greater the ink collector needs to be.

However, forming a larger ink collector needs more cost. There is another drawback that making the ink collector larger in diameter results in the loss of stylish appearance. Alternatively, if the ink collector is long, the feeder means, such as a center core or the like, which penetrates through the ink collector and leads ink to the writing portion becomes long, so that the long collector configuration produces disadvantages as to forward leakage since the head of ink acts on the writing portion.

In general, it is well known that the ink retention volume of the ink collector is set at 10 to 30% of the ink tank volume. However, there have been demands for the reduction of the size of the ink collector while keeping the ink tank size, or for enlarging the size of the ink tank while keeping the ink collector as is.

As the prior art examples, Japanese Utility Model Publication Hei 4 No. 36293 and Japanese Utility Model Publication Hei 4 No. 45914 are disclosed in which a pipe element is arranged inside the ink tank to prevent ink blow-out to the outside of the writing element due to a temperature rise and reduction in pressure.

In Japanese Utility Model Publication Hei 4 No. 36293, a tubular valve assembly is provided inside the ink tank to discharge air expanded in the ink tank to the outside when a temperature rise or reduction in pressure occurs, to thereby prevent ink blow-out from the writing point. This prior art example is featured in that the ink storage portion is filled with ink less than half-full and is also characterized by having a valve mechanism in that an area inaccessible to ink is created so that there is continuous communication between the surroundings outside the writing point and the air inside the ink storage.

This prior art example first has the drawback in that the ink tank can be filled with ink less than half-full. If the tank is filled more than half-full and ink reaches the rear end opening of the tubular valve assembly, ink will leak as the air inside the ink tank expands due to a temperature rise or reduction in pressure and blow out by the amount corresponding to the air expansion. Therefore, this prior art example has the problem in that the entire ink tank cannot be filled up with ink.

Further, though in common with all the writing implements having a valve mechanism, the writing point has to be pressed against the paper surface or the like during writing, there is a problem that writers with a light touch will face difficulties in writing.

Other than the tube that discharges the expanded air to the outside, the above prior art example further uses extra parts such as a spring enabling the valve to open and close by pressing of the writing point, needing more parts and hence costing more.

Moreover, since in this prior art example, communication between the area inaccessible to ink in the ink storage portion and the ambient space outside the writing point is established continuously, direct application of this prior art example characterized by the tubular valve assembly to a direct-feed type writing implement having an ink collector will cause the forward leakage problem, i.e., the defect of ink leaking from the writing point. That is, this prior art can be applied only to configurations involving a valve.

Next, in Japanese Utility Model Publication Hei 4 No. 45914, a tubular valve assembly is provided to discharge the expanded air due to a reduction in pressure or temperature rise to the outside, and this tubular valve assembly is extended to the bottom of the ink tank. Further, the rear end of the point assembly is connected to the first tubular valve assembly so that pressing the writing point will open the valve of the tubular valve assembly to thereby equalize the pressure inside the ink storage chamber to the atmospheric pressure. However, this prior art example has the problems as follows.

First, as stated above, since the writing point of a valve type has to be pressed against the paper surface or the like during writing, writers with a light touch face difficulties in writing. In this prior art example, two valves need to be opened for writing, so that light-handed writers experience much more difficulty.

Secondarily, this configuration uses two values, needing more parts and costing more, compared to the first prior art example (Japanese Utility Model Publication Hei 4 No. 36293).

There is another problem. That is, under the situation in which a temperature rise or reduction in pressure is occurring, if the first valve element is opened with the writing point put upwards as when writing is performed with its writing point upwards, the ink will be pushed up inside tubular vale assembly due to the pressure inside the ink tank, causing ink leakage from the writing point.

SUMMARY OF THE INVENTION

The present invention is to solve the above problems. Particularly, the object of the present invention is to provide a direct-feed type writing implement having an ink tank equal in volume to that of the conventional configuration but using an ink collector smaller than that of the conventional configuration, or to provide a direct-feed type writing implement having a ink collector equal in size to that of the conventional configuration but being able to store a greater amount of ink than the conventional configuration.

It is another object of the present invention to provide a writing implement which is free from the conventional problems with the conventional configurations in that the entire ink tank cannot be filled up with ink, or ink blow-out occurs with its writing point upwards if the ink tank is filled up with ink and allows the entire ink tank to be filled up with ink without any ink leakage from the writing point when the writing point is set upwards as well as when the writing point is set downwards.

It is a further object of the present invention to provide a writing implement free from the problem that a valve type writing implement makes it difficult for light-handed writers to write, by providing a direct-feed type configuration using an ink collector.

Moreover, it is still another object of the present invention to provide a direct-feed type writing implement which solves the forward leakage problem, which would occur if the principle of Japanese Utility Model Publication Hei 4 No. 36293 is directly applied to a writing implement using an ink collector, by introducing a new mechanism.

Finally, the present invention is to provide a writing implement which is free from the cost problem due to more parts needed in a valve type configuration and still can effectively prevent ink leakage.

In order to achieve the above objects, the present invention is configured as follows:

In accordance with the first aspect of the present invention, a direct-feed type writing implement includes:

a point assembly having a writing point at the tip thereof;

an ink tank directly storing a relatively low viscosity ink having a viscosity of 2 to 100 mPa·S at room temperature;

an ink collector for adjusting the internal pressure in the ink tank by utilizing capillarity;

a feeder means including a center core, for feeding ink from the ink tank to the writing point; and a duct pipe connecting the ink collector and the ink tank, and is characterized in that ink is supplied to the center core as the ink feeder means only through the duct pipe.

In accordance with the second aspect of the present invention, a direct-feed type writing implement includes:

a point assembly having a writing point at the tip thereof;

an ink tank directly storing a relatively low viscosity ink having a viscosity of 2 to 100 mPa·S at room temperature;

an ink collector for adjusting the internal pressure in the ink tank by utilizing capillarity;

a feeder means including a center core, for feeding ink from the ink tank to the writing point;

a duct pipe connecting the ink collector and the ink tank; and a duct pipe ink storage portion provided for the duct pipe, and is characterized in that ink is supplied to the center core as the ink feeder means only through the duct pipe.

In accordance with the third aspect of the present invention, the direct-feed type writing implement having the above second feature is characterized in that the duct pipe ink storage portion provided for the duct pipe is located near the end part of the ink tank.

In accordance with the fourth aspect of the present invention, the direct-feed type writing implement having the above second feature is characterized in that the duct pipe ink storage portion provided for the duct pipe is located close to the interior wall of the ink tank.

In accordance with the fifth aspect of the present invention, the direct-feed type writing implement having the above first or second feature is characterized in that the end part of the duct pipe or the end of the duct pipe ink storage portion is located approximately at the midpoint of the ink tank or closer to the ink tank bottom than the midpoint.

In accordance with the sixth aspect of the present invention, the direct-feed type writing implement having the above first or second feature is characterized in that the ink collector is provided with an ink channel forming an air-liquid exchanger, and the ink feeder portion for leading ink to the ink channel is formed on the ink collector end face on the ink tank side.

In accordance with the seventh aspect of the present invention, the direct-feed type writing implement having the above first or second feature is characterized in that a fine hole is formed in the communication passage for creating communication between the ink collector for adjusting the internal pressure in the ink tank by utilizing capillarity and the ink feeder means including a center core.

In accordance with the eighth aspect of the present invention, the direct-feed type writing implement having the above first or second feature is characterized in that, when the ink surface is above the duct pipe end portion or the end of the duct pipe ink storage portion with the writing point set downwards, the expansion of the air space when the temperature of the ink tank is increased from room temperature to about 50° C., is equal to or lower than the ink retention volume of the ink collector.

In accordance with the ninth aspect of the present invention, the direct-feed type writing implement having the above first or second feature is characterized in that, when the ink surface is above the duct pipe end portion or the end of the duct pipe ink storage portion with the writing point set upwards, the expansion of the air space when the temperature of the ink tank is increased from room temperature to about 50° C., is equal to or lower than the sum of the ink retention volume of the ink collector and the volume of the clearance formed between the barrel wall and the ink collector.

In accordance with the tenth aspect of the present invention, the direct-feed type writing implement having the above first or second feature is characterized in that, when the duct pipe is formed with the duct pipe ink storage portion and when the duct pipe is formed with the ink storage portion and an ink pool, the total volume including the retention volume of the duct pipe, the duct pipe ink storage portion and the ink pool, is equal to or smaller than the retention volume of the ink collector.

In accordance with the eleventh aspect of the present invention, the direct-feed type writing implement having the above first or second feature is characterized in that the ink tank is charged with ink until almost full.

In accordance with the twelfth aspect of the present invention, the direct-feed type writing implement having the above first feature is characterized in that the end portion of the duct pipe is shaped into a beveled configuration.

In accordance with the thirteenth aspect of the present invention, the direct-feed type writing implement having the above second feature is characterized in that the end portion of the duct pipe and the duct pipe ink storage portion are shaped into a beveled configuration.

In accordance with the fourteenth aspect of the present invention, the direct-feed type writing implement having the above second feature is characterized in that the duct pipe ink storage portion are shaped into a beveled configuration.

In accordance with the fifteenth aspect of the present invention, a direct-feed type writing implement includes:

a point assembly having a writing point at the tip thereof;

an ink tank directly storing a relatively low viscosity ink having a viscosity of 2 to 100 mPa·S at room temperature;

an ink collector for adjusting the internal pressure in the ink tank by utilizing capillarity;

a feeder means including a center core, for feeding ink from the ink tank to the writing point; and a duct pipe connecting the ink collector and the ink tank, and is characterized in that the duct pipe has a duct pipe ink storage portion at a position close to the ink tank end and the inner wall of the ink tank, the end of the duct pipe ink storage portion is located approximately at the midpoint of the ink tank or closer to the ink tank bottom than the midpoint, and ink is supplied to the center core as the ink feeder means only through the duct pipe.

DESCRIPTION OF THE PREFERRED EMBODIMENTS

The operations of the embodiments will hereinafter be described in detail with reference to the accompanying drawings.

To begin with, the means for achieving the present invention will be described. The ink used is a low (or medium) viscosity ink having a viscosity ranging from 2 to 100 Pa·S at room temperature (about 23° C.). Alternatively, a pseudo-plastic ink (also to be referred to as gel ink) which presents a higher viscosity in its stationary state to prevent forward leakage of ink from the writing point and lowers its viscosity to permit smooth writing when the writing point is moved or stressed by shearing force during writing, may be used. As the solvent for the ink base, water, which is typical, may be used. Other than water, organic solvents such as lower alcohols, higher alcohols, xylene and the like, glycols such as ethylene glycol etc., and their esters which are applicable to ink for writing implements, may be used as appropriate.

In the embodiments shown hereinbelow, the duct pipe supporter is formed between the duct and the barrel wall, it may of course be formed between the duct and ink collector. Alternatively, instead of providing a duct pipe supporter, the duct pipe may be directly fixed to the barrel or ink collector.

The barrel used in the present invention for storing ink is preferably a see-through one which allows the user to monitor the ink consumption because the ink used is of a direct-feed type. Therefore, it is preferred that the barrel is formed of polypropylene or the like which is transparent.

As one of the features of the present invention, ink supply to the center core or the like as the ink feeder means is only allowed through the duct pipe. There are various methods to prohibit ink supply to the center core or the like, as the ink feeder means, other than through the duct pipe. Specifically, the duct pipe may be bonded to or squeezed into the barrel, or the duct pipe and barrel may be integrally formed.

Here, 'prohibiting ink supply to the center core or the like, as the ink feeder means, other than through the duct pipe' includes not only the case where ink may be directly supplied to the center core etc., as the ink feeder means through the duct pipe, but also indicates the case where ink from the duct pipe may be once retained in an ink retainer and then this retained ink may be supplied to the feeder means such as a center core and the like.

Various shapes can be considered concerning the shape of the duct pipe, particularly the sectional shape, but a circular shape is preferred in view of ease of air and ink flow.

The ink feeder portion may be formed in any shape such as a projected or depressed shape as long as it can feed ink to the ink channel. It is preferable that the ink feeder portion is put into contact with the feeder core in order to efficiently lead ink to the ink collector.

Figure 1:
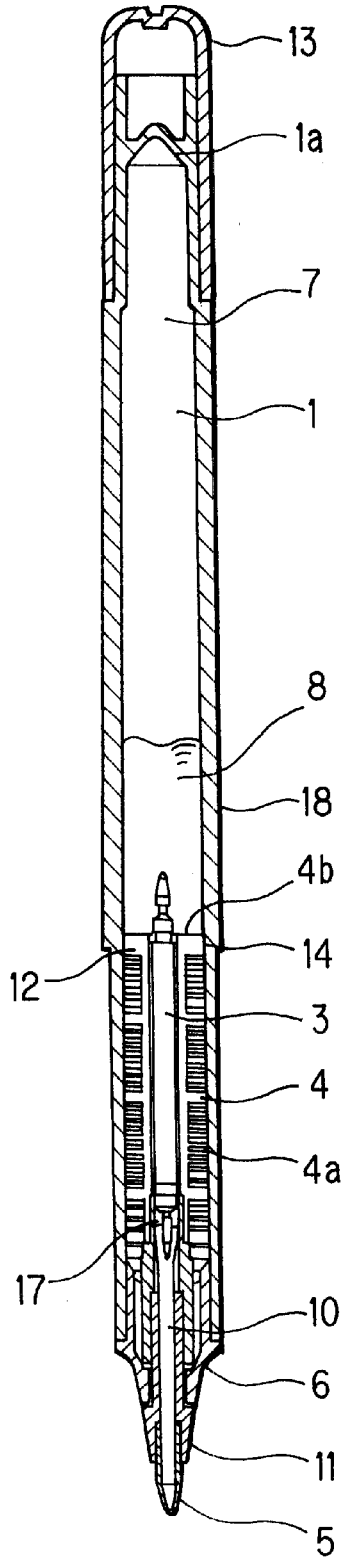
FIG. 1 PRIOR ART
FIG. 1 is a vertical sectional view showing the overall configuration of a writing implement of a prior art example.

Now, the illustrated embodiments will be further detailed. FIG. 1 shows the conventional embodiment, and the others show the embodiments of the present invention. FIG. 1 is a conventionally existing, water-based ball point pen UB-150, a product of MITSUBISHI PENCIL CO., LTD., having a vane-regulator type ink collector (ink retention volume of about 0.3 $cm^3$). As an example of an ink collector, a vane-regulator type ink collector will be described. However, ink collectors should not be limited to the vane-regulator type. The total volume of the ink contained in UB-150 is approximately 2.0 $cm^3$. In FIG. 1, reference numerals 6, 11 and 13 designate a plastic mouthpiece, joint and tail plug, respectively.

The requirements on the embodiments shown hereinbelow are to deal with the change in the temperature of the ink tank from about 20° C., the room temperature, to a warm temperature at about 50° C. In daily use circumstances, the temperature of the ink tank will reach 30 to 35° C. from the air temperature and the body temperature of the user of the writing implement. However, the temperature is considered to reach up to about 50° C. in some climatic situations in summer. Since the amount of ink blow-out becomes maximum at around this temperature, it was decided that the range of heating should be set at about 50° C. The ink, ink collector, ink feeder core and other components of the UB-150 were used for evaluation.

With the conventional example shown in FIG. 1, when the ink has been consumed to a certain degree forming a large empty space 7 in an ink tank 1 and when the amount of residual ink is greater than the retention volume of ink collector 4, the risk of ink blow-out will become maximum if the air inside the ink tank expands due to reduction in pressure and/or increase in temperature.

Specifically, suppose the ink retention volume of ink collector 4 is 0.3 $cm^3$(0.3 cc) and the amount of ink is 0.5 $cm^3$ while the volume of the space in ink tank 1 is about 1.5 $cm^3$, the risk of ink blow-out becomes high. That is, with the ink collector having a retention volume of 0.3 $cm^3$, the upper limit of the volume of ink tank 1 is about 2 $cm^3$.

Next, the present invention will be further detailed referring to the first to fourth embodiments.

With reference to FIGS. 5A to 5D and FIGS. 6A to 6D, the principle of prevention of ink blow-out and writing of the present invention will be described. FIGS. 5A to 5D are illustrative views showing the writing implement of the first embodiment shown in FIG. 2 and the four stages of the ink tank 1 state when the writing point 5 is set downwards. FIGS. 6A to 6D are illustrative views showing the writing implement of the first embodiment shown in FIG. 2 and the four stages of the ink tank 1 state the writing point 5 is set upwards. FIGS. 5A to 5D show the way ink is consumed, sequentially from FIG. 5A to FIG. 5D. FIGS. 6A to 6D are the same.

Figure 3:
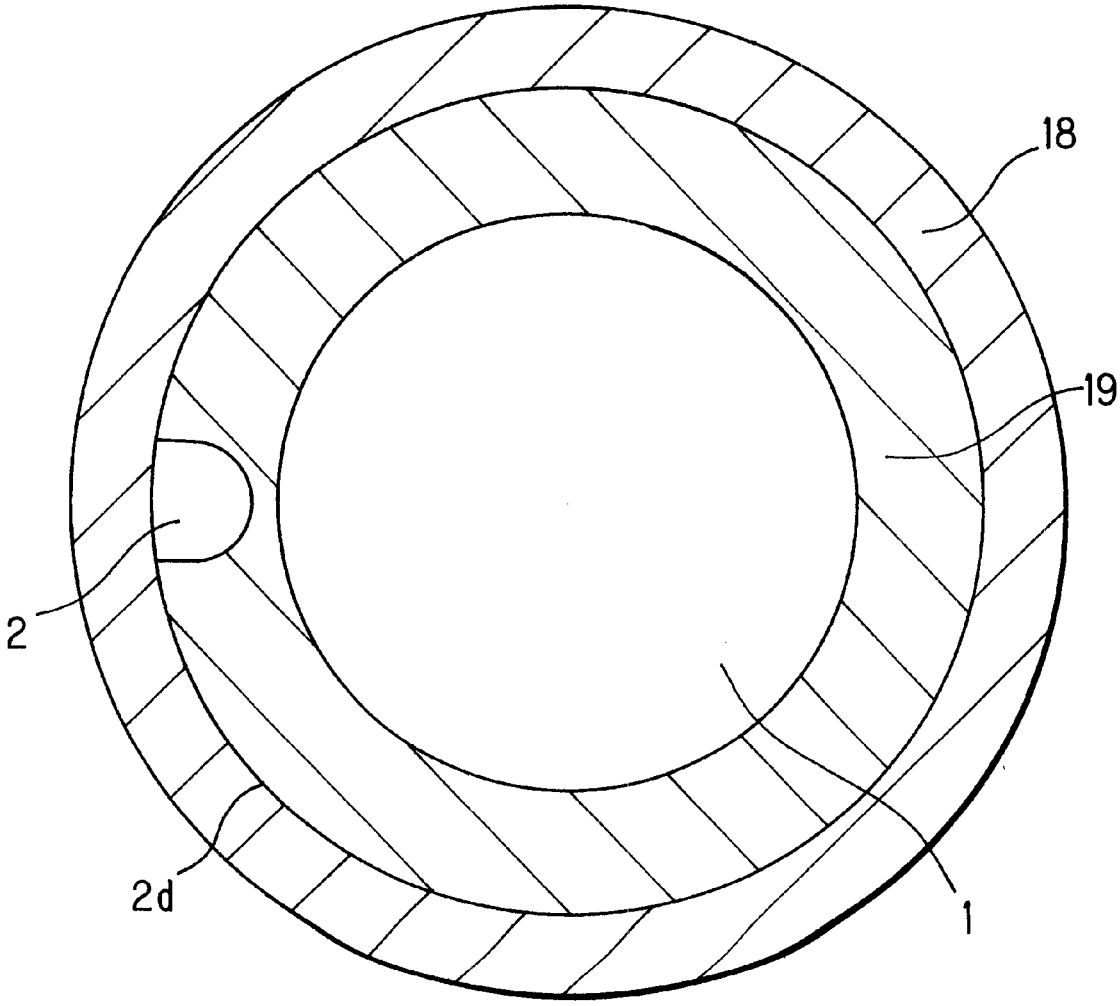
FIG. 3 is a sectional view cut along a plane A—A in FIG. 2.
Figure 4:
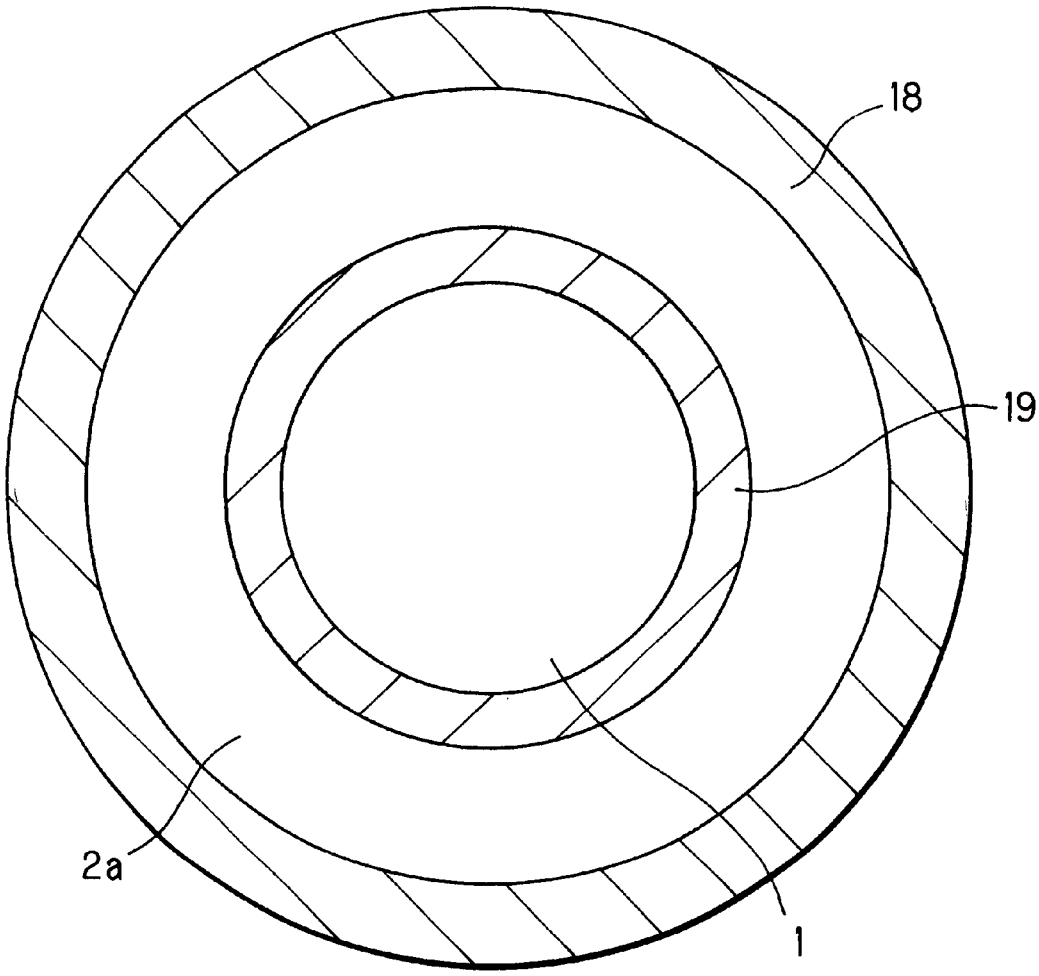
FIG. 4 is a sectional view cut along a plane B—B in FIG. 2.

Also as shown in FIGS. 3 and 4, a barrel 19 is provided inside the ink tank, and a duct pipe 2 is formed between this barrel 19 and a barrel 18. Further, ink 8 to a feeder core 3, a center core 10 and writing point 5 is supplied through duct pipe 2. Barrel 19 has a bottom, through which no ink is supplied to feeder core 3.

Here, a point assembly comprises; a writing point 5, a center core 10, a tail plug 13, etc., wherein the writing point 5 may be of such types as a ball-point pen, felt pen, sintered core with point, and the like.

In any of the states shown in FIGS. 5A to 5D and FIGS. 6A to 6D, since barrel 19 is totally sealed from barrel 18, ink is supplied to feeder core 3 only through duct pipe 2.

Figure 2:
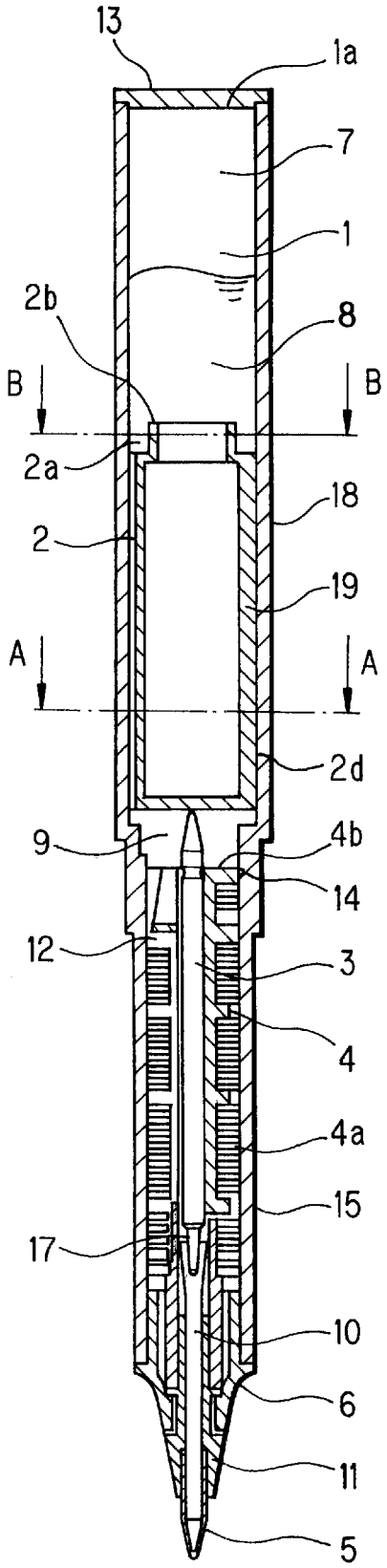
FIG. 2 is a vertical sectional view showing the overall configuration of a writing implement in accordance with first embodiment of the present invention.
Figure 5A:
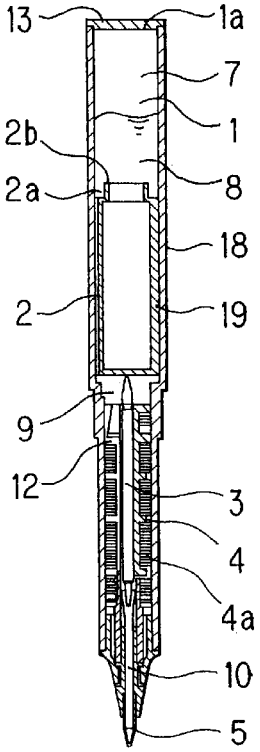
FIGS. 5A to 5D are illustrative views showing the writing implement of the first embodiment shown in FIG. 2 and the four stages of the ink tank state when the writing point is set downwards.

FIGS. 5A to 5D are illustrative views showing the writing implement of the embodiment shown in FIG. 2 and the four stages of the ink tank 1 state when the writing point 5 is set downwards. FIG. 5A shows the state where the liquid surface of the ink is above the end 2*b* of the duct pipe ink storage portion. In this case, ink for writing is supplied from the ink in duct pipe 2 and the duct pipe ink storage portion 2*a*, the ink stored in an ink pool 9 and the ink existing higher than the end 2*b* of the duct pipe ink storage portion.

The principle of preventing ink blow-out in this case is as follows. When the surroundings of the pen body are affected by temperature rise, pressure drop or the like, empty space 7 in ink tank 1 starts expanding. As the air expands, the ink corresponding to the expansion enters ink collector 4 via duct pipe 2. Here, if ink in excess of the ink retention volume of ink collector 4 is supplied through duct pipe 2, ink blow-out will occur. Therefore, in order to effectively prevent ink blow-out when the ink surface is located above the end 2*b* of the duct pipe ink storage portion with writing point 5 set approximately downwards, it is necessary to limit the expansion of air space 7 when the surroundings are increased in temperature from room temperature to about 50° C., equal to or lower than the ink retention volume of ink collector 4.

In this case, ink can be supplied to writing point 5 via duct pipe 2 until the ink surface reaches the level of the end 2*b* of the duct pipe ink storage portion since the level of the ink surface is higher than the end 2*b* of the duct pipe ink storage portion. Therefore, in this case, continuous ink supply is made possible without the necessity of turning the writing point 5 upwards. Air replacement during writing in this case is performed through an ink channel(small channel) 12 so that air bubbles arising go up through duct pipe 2 to ink tank 1.

Figure 5B:
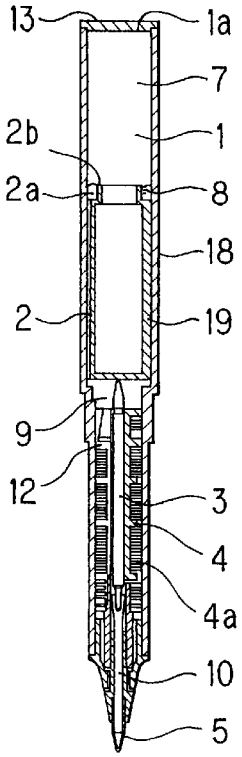
Figure 5C:
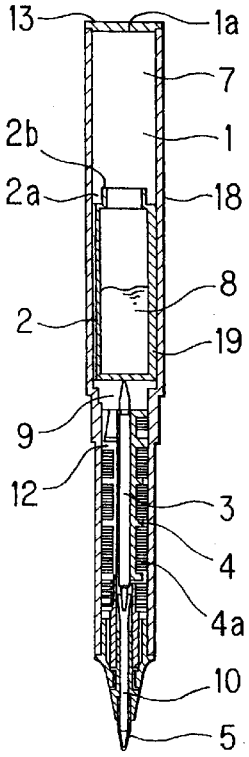
Figure 5D:
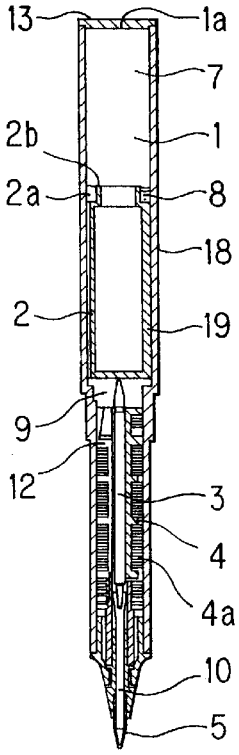

Next, when the ink level in ink tank 1 is approximately equal to that of the end 2*b* of the duct pipe ink storage portion as shown in FIG. 5B, the ink retained in duct pipe 2, duct pipe ink storage portion 2*a* and ink pool 9 enters ink collector 4. Therefore, by specifying the total amount of ink within duct pipe 2, duct pipe ink storage portion 2*a* and ink pool 9, at 0.3 $cm^3$ or lower, it is possible to prevent ink blow-out regardless of the amount of ink around duct pipe 2. The principle of blow-out prevention for the cases shown in FIGS. 5C and 5D is the same as that shown in FIG. 5B. Since the ink retained in duct pipe 2, duct pipe ink storage portion 2*a* and ink pool 9 enters ink collector 4, the total amount of these should be specified to be equal to or lower than 0.3 $cm^3$, thus making it possible to prevent ink blow-out. Therefore, in order to effectively prevent ink blow-out, the total retention volume of duct pipe 2, duct pipe ink storage portion 2*a* and ink pool 9 should be designed to be equal to or lower than that of ink collector 4.

Ink supply for writing in this case is performed from duct pipe 2, duct pipe ink storage portion 2*a* and ink pool 9.

Next, with reference to FIGS. 6A to 6D, the principle of ink blow-out prevention when the writing point 5 is set upwards will be described. Similar to FIGS. 5A to 5D, FIGS. 6A to 6D show the way ink is consumed, sequentially from FIG. 6A to FIG. 6D.

Figure 6A:
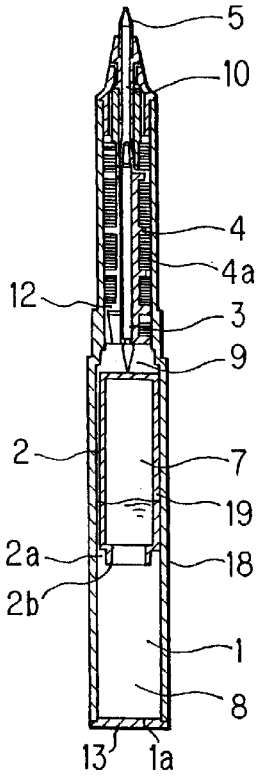
FIGS. 6A to 6D are illustrative views showing the writing implement of the first embodiment shown in FIG. 2 and the four stages of the ink tank state when the writing point is set upwards.

First, in the case in FIG. 6A, if the pen is warmed or the pressure reduced, the air above the ink surface expands. Since this air has no way of escape, the volume of ink equivalent to that of air expansion is pushed up through duct pipe 2 to enter ink collector 4. In this embodiment, the ink holding space above the end 2*b* of the duct pipe ink storage portion (on the writing point 5 side) is designed to be about 2.2 $cm^3$, which is greater than the ink holding space below (on the ink tank bottom la side). For instance, the amount of ink above the end 2*b* of the duct pipe ink storage portion is assumed to be 0.5 $cm^3$, the volume of the space is 1.7 $cm^3$. In this state, the pen is warmed up to about 50° C., the amount of air expansion is about 0.2 $cm^3$. Also evaporation of ink should be taken into account. In this case, it is possible to prevent ink blow-out as long as the sum of the air expansion volume and the volume expansion due to ink evaporation is approximately equal to or even marginally greater than the retention volume of ink collector 4. Here, when the writing point is set upwards, the reason for being possible to prevent ink blow-out if the total expansion volume is approximately equal to or even marginally greater then the retention volume of ink collector 4 is owing to the fact that not only the spaces between ink collector vanes 4*a* but also the clearance between barrel 18 and ink collector 4 can be used and also that the gravity on the ink also produces resistance, as will be described later. When the pen is turned from this state so that the writing point is set downwards for writing, the pen is put in the same state as shown in FIG. 5A. Therefore, ink will be supplied based on the same principle as stated with reference to FIG. 5A.

Figure 6B:
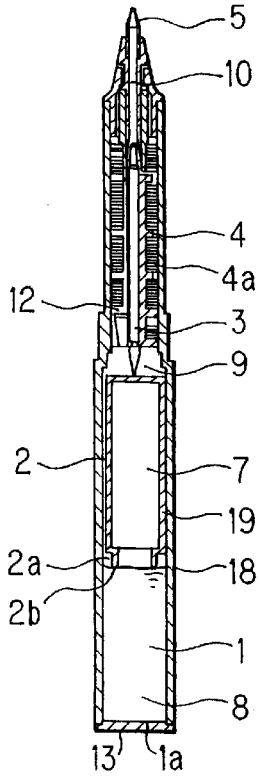

Next, the case in FIG. 6B will be described. In FIG. 6B, if the pen is affected by being warmed or pressure drop, the air space above the level of the end 2*b* of the duct pipe ink storage portion expands. In this case, ink in contact with the end 2*b* of the duct pipe ink storage portion enters ink collector 4 via duct pipe 2 but soon the level of the ink surface lowers proportionally to this ink entrance so the liquid surface will separate from the end 2*b* of the duct pipe ink storage portion. Then, in turn air comes into contact with the end 2*b* of the duct pipe ink storage portion, and expanded air will be discharged out via ink channel 12 of ink collector 4 hence no more ink will enter ink collector 4. In this way, entrance of ink into ink collector 4 is very small, so no ink blow-out will occur.

Figure 6C:
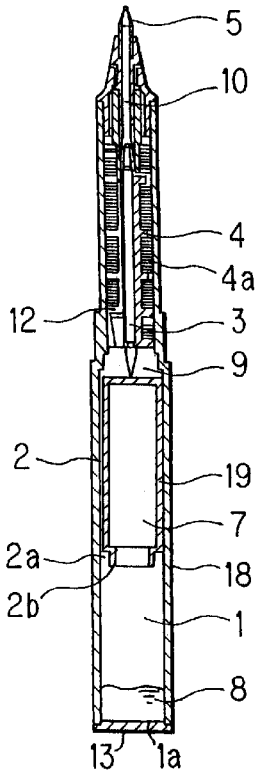

Further, when the ink in the ink tank has been consumed as shown in FIG. 6C so that the ink surface is totally separated from the end 2*b* of the duct pipe ink storage portion, only the expanded air due to being warmed and/or reduction in pressure escapes through duct pipe 2 and the ink slightly remaining within duct pipe 2 enters ink collector 4. Thus, it is possible to prevent ink blow-out.

Figure 6D:
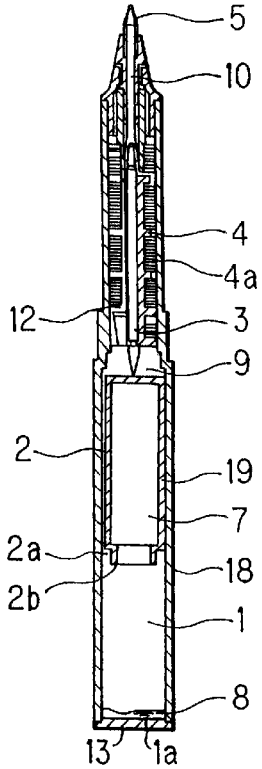

Finally, when the ink in the ink tank has been almost used up as shown in FIG. 6D, only the ink remaining within duct pipe 2, duct pipe ink storage portion 2*a* and ink pool 9 will enter ink collector 4. Also in this case, ink blow-out can be prevented as in the case of FIG. 6C. Therefore, in order to effectively prevent ink blow-out, it is necessary that the toner ink storage volume of duct pipe 2, duct pipe ink storage portion 2*a* and ink pool 9 should be approximately equal to or lower than the sum of the ink retention volume of the ink collector and the volume of the space or clearance formed between barrel 18 and ink collector 4. Here, the principle of ink supply for writing is the same as that described with reference to FIGS. 5B to 5D.

In theory, if the end 2*b* of the duct pipe ink storage portion is located at the approximately midpoint of the ink tank, the above principle can be performed. In practice, however, since the retainable amount of ink differs between when the pen is put with its writing point upwards and when it is put with its writing point downwards, it is preferred that the end 2*b* of the duct pipe ink storage portion is positioned on the ink tank bottom 1*a* side with respect to the approximately midpoint of the ink tank. With writing point 5 put downwards, ink retention of ink collector 4 is achieved only by the gaps between ink collector vanes 4*a* in ink collector 4, whereas with the writing point placed upwards, ink is retained not only by the vanes but also by ink filling the clearance between barrel 18 and ink collector 4. That is, a greater amount of ink can be retained when the writing point is upwards than when the writing point is downwards. When writing point 5 is upwards, ink has to enter ink collector 4 opposing gravity, which provides resistance against the ink entrance into ink collector 4. Therefore, a more improved safety for blow-out prevention can be obtained when the writing point is set upwards than when the writing point is set downwards.

When, in FIGS. 5B to 5D, the ink within duct pipe 2, duct pipe ink storage portion 2*a* and ink pool 9 is completely used up and it becomes impossible to write, it is necessary to supply ink 8 into duct pipe ink storage portion 2*a* by turning writing point 5 upwards and again turning it downwards. Accordingly, in order to make ink supply to duct pipe ink storage portion 2*a* easy, it is preferred that ribs or the like for leading ink 8 to duct pipe ink storage portion 2*a* are formed on the internal wall of barrel 18.

Next, the embodiments shown in FIGS. 7 and 8 will be described. The principle of blow-out prevention and the principle of ink supply for writing are the same as in the first embodiment of FIG. 2.

Figure 7:
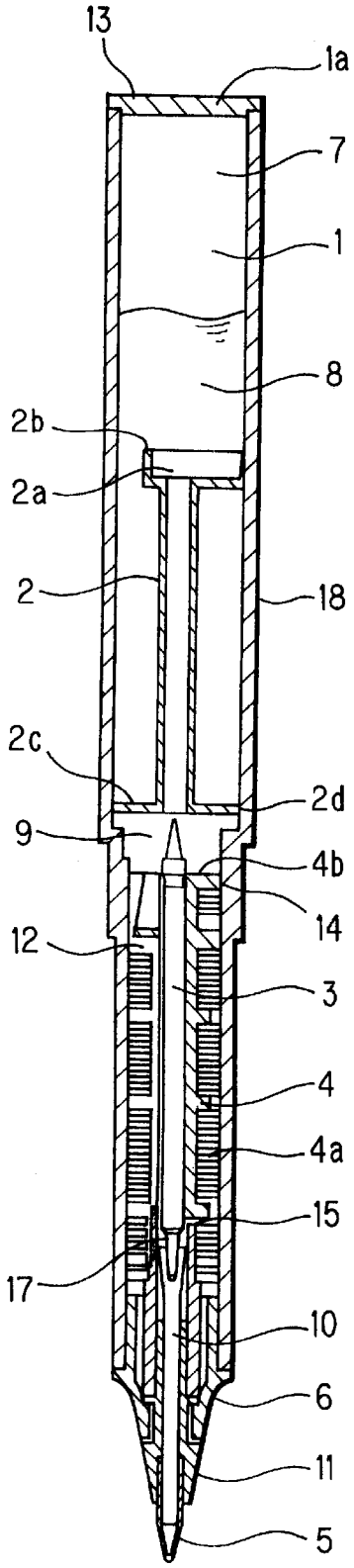
FIG. 7 is a vertical sectional view showing the overall configuration of a writing implement of the second embodiment of the present invention.

FIG. 7 shows the second embodiment of the present invention, in which a duct pipe 2 is supported by a duct pipe support member 2*c* instead of providing barrel 19. Duct pipe ink storage portion 2*a* is in contact with barrel 18 so as to perform effective functions when the level of ink 8 is below the end 2*b* of duct pipe ink storage portion with writing point 5 set downwards. That is, once writing point 5 is turned upwards and again turned downwards, ink 8 gathers into duct pipe ink storage portion 2*a*, flowing along the internal wall surface of barrel 18, to enable ink supply to writing point 5 via duct pipe 2.

Figure 8:
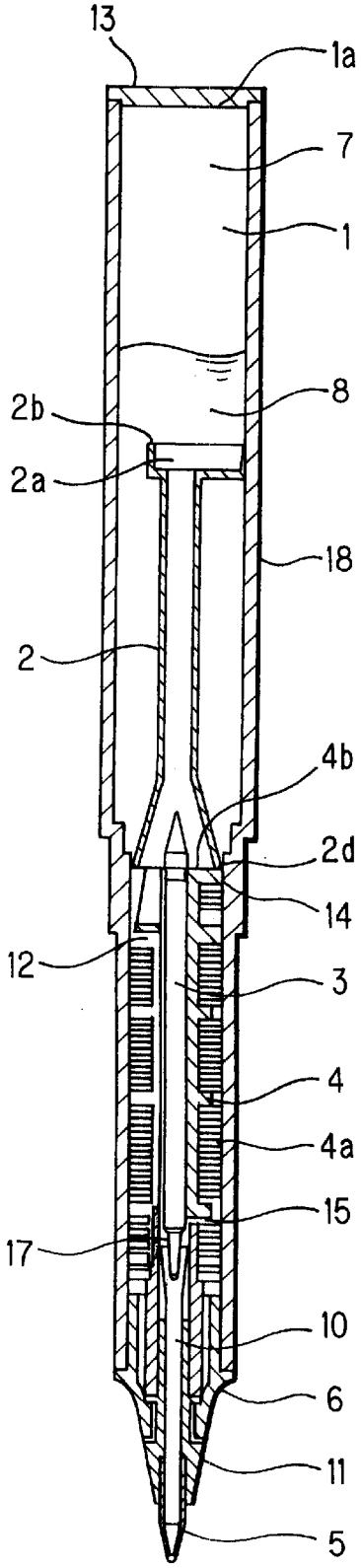
FIG. 8 is a vertical sectional view showing the overall configuration of a writing implement of the third embodiment of the present invention.

FIG. 8 shows the third embodiment of the present invention, in which a duct pipe 2 is connected directly to an ink collector 4. In this case, no ink pool 9 is provided. Other configuration is the same as the second embodiment.

In both the second and third embodiments, it is necessary to seal support member 2*d* of duct pipe 2 so that ink 8 will not enter the feeder cores 3 and 10, as the ink feeder means, other than through duct pipe 2.

In the second and third embodiments shown in FIGS. 7 and 8, though duct pipe ink storage portion 2*a* only comes in partial contact with ink tank 1, the shape of ink storage portion 2*a* can be designed as appropriate as long as it can collect ink 8.

In each of the above embodiments, one or more small holes 15 are preferably formed between ink collector vanes 4*a* on ink collector 4 so as to establish communication between the collector and a communication passage 17 through which ink feeder means 3 and 10 such as feeder cores and the like, penetrate. For instance, in the situations shown in FIG. 5C and FIG. 5D, air expanded by being warmed and/or reduction in pressure is discharged out via duct pipe 2. When the rate of being warmed or the rate of reduction in pressure is too low, the air in ink tank 1 expands very slowly. In this case, it is difficult for the slowly expanding air to break the meniscus of the ink formed on a sealing surface 14 of ink collector 4. In this case, instead of discharging air outside, the ink retained in ink pool 9 and ink 8 held in feeder core 3 and center core 10, equivalent to the volume of air expansion, will be discharged out from writing point 5. As a result, forward leakage that causes ink blobbing from writing point 5 occurs staining clothes and the like. If small holes 15 are provided, the ink having passed through feeder core 3 will enter the sites between ink collector vanes 4*a* through the small holes 15. In a so-called ball-point pen having writing point 5 as above, since the ball itself serves as a plug and since capillarity arises between ink collector vanes 4*a*, ink will not flow to the writing point but flows to small holes 15, never causing forward leakage.

Figure 9:
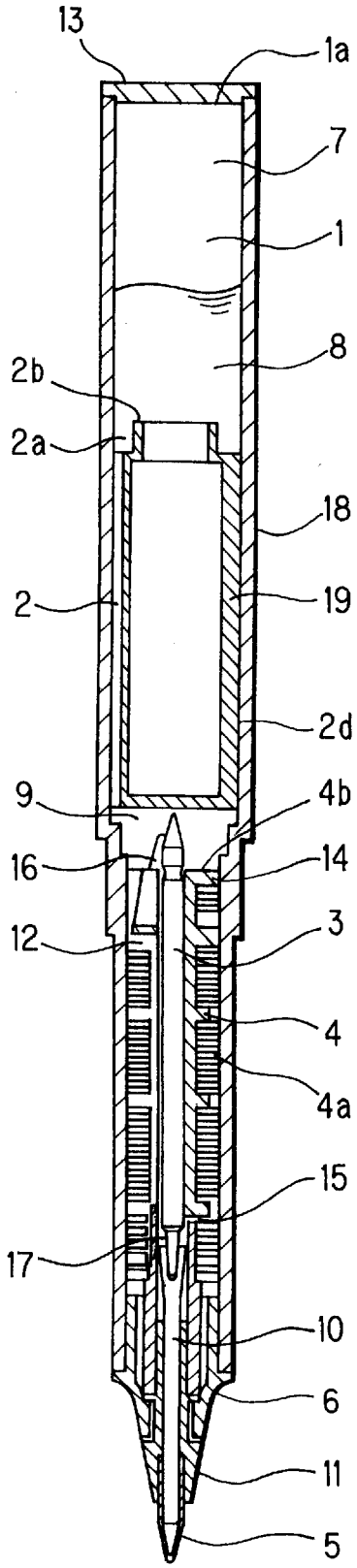
FIG. 9 is a vertical sectional view showing the overall configuration of a writing implement of the fourth embodiment of the present invention.
Figure 10:
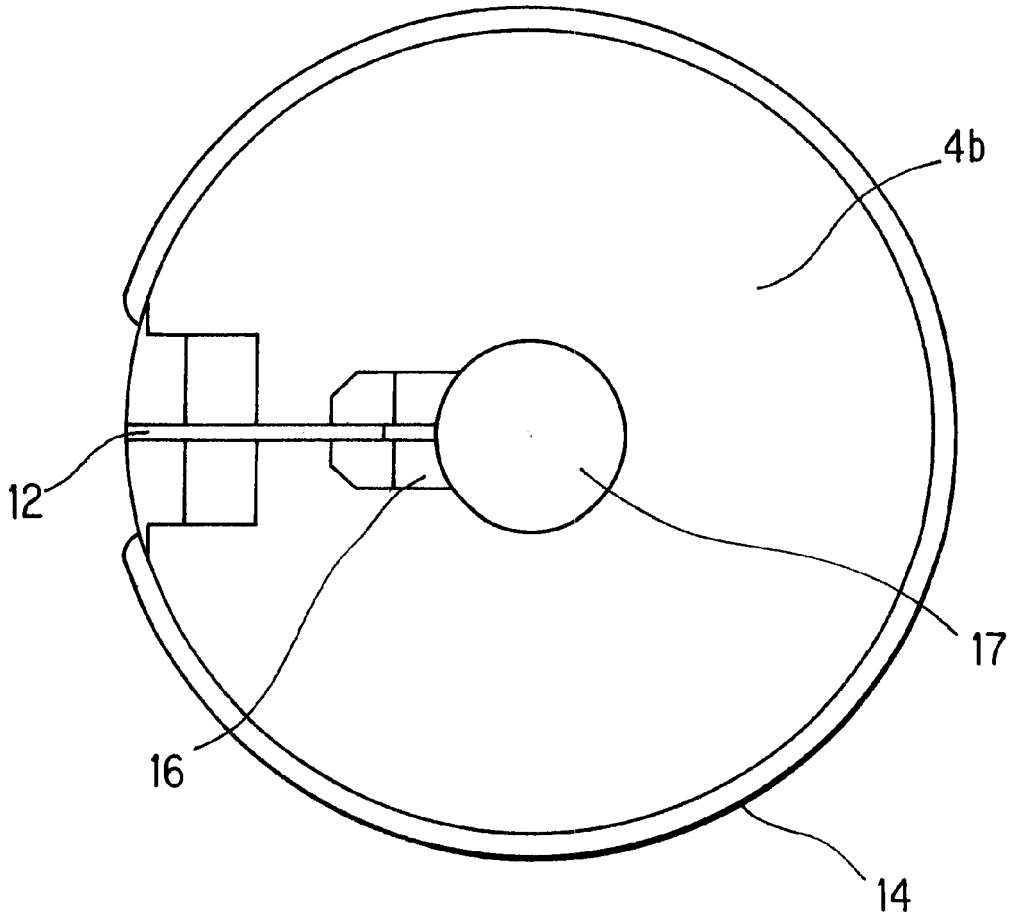
FIG. 10 is a plan view showing an ink collector in the fourth embodiment shown in FIG. 9.

In order to achieve further improved prevention against forward leakage, it is effective to provide an ink feeder portion 16 shown in FIGS. 9 and 10. This ink feeder portion 16 in the fourth embodiment is formed with a slit of 0.05 to 0.3 mm wide defined by two plate-like elements and is directly connected to the ink collector end face, designated at 4*b*. Also in this case, with the pen in the state shown in FIG. 5C or 5D, if air expands due to being warmed or reduction in pressure, the expanded air passes through duct pipe 2 to be discharged outside. If air is slowly warmed or reduced in pressure, the air in ink tank 1 expands very slowly. In such a case, it is very difficult for the slowly expanding air to break the ink meniscus created on sealing surface 14 of ink collector 4. Resultantly, there occurs a high possibility that the ink in ink pool 9, the ink impregnated in feeder core 3 and center core 10, up to the amount corresponding to the volume of air expanded inside ink tank 1, might go toward writing point 5 by way of center core 10, causing forward leakage. In this case, however, ink feeder portion 16 presents capillarity because of its sufficiently small slit width, so that the ink being in ink pool 9, feeder core 3 and center core 10 is introduced by this ink feeder portion 16 into ink collector 4, thus making it possible to reduce entrance toward writing point 5. In this way, provision of ink feeder portion 16 may reduce forward leakage.

The total storage amount of ink in the embodiments shown in FIG. 2 and FIGS. 5A to 5D to FIG. 9 is approximately 3.5 $cm^3$ while the ink retention volume of ink collector 4 is about 0.3 $cm^3$ as in the conventional example UB-150. Therefore, compared to the ink volume of 2.0 $cm^3$ of the conventional direct-feed type writing implement, the total storage amount of ink increases to 1.75 times with the same retention volume of ink collector 4. This means that a direct-feed type writing implement of the same volume of ink tank 1 can be provided using a smaller ink collector 4 than the conventional one. Alternatively, if an ink collector 4 of the same size as conventional is used, it is possible to provide a direct-feed type writing implement capable of keeping a greater amount of ink.

In any of the above embodiments, owing to the above principle of blow-out prevention and writing, ink tank 1 can be charged full of ink, compared to the conventional example (Japanese Utility Model Publication Hei 4 No. 36293), where ink can be charged to the ink tank only up to half-full. In the practical assembly etc., in order to prevent ink from overflowing during assembly or for other purposes, ink may be charged to the ink tank, not to the full level but leaving some air.

Figure 11:
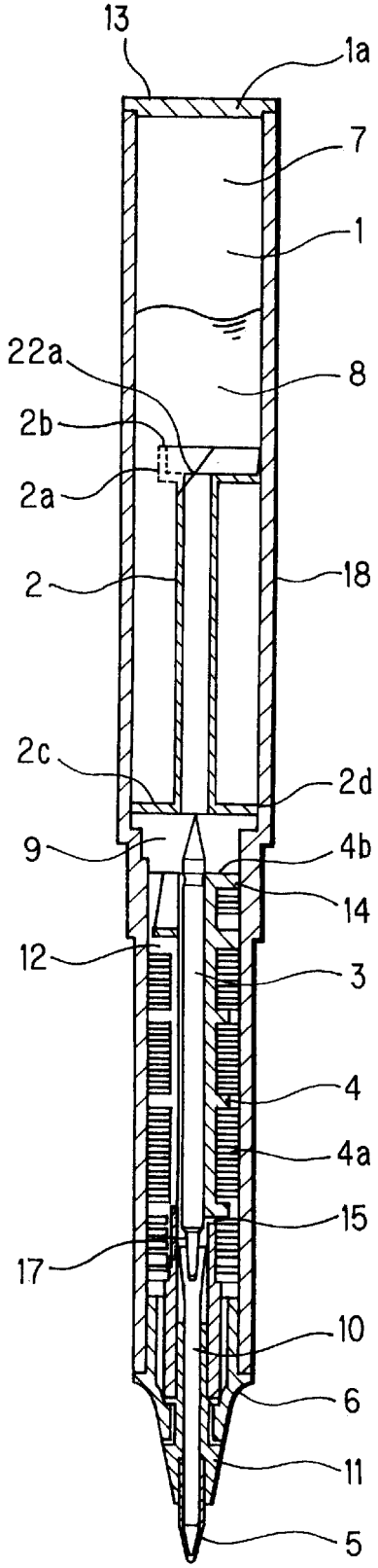
FIG. 11 is a vertical sectional view showing a variational example of the second embodiment shown in FIG. 7.

FIG. 11 shows a variational example of the second embodiment of the present invention, where the end part of duct pipe 2 and duct pipe ink storage portion 2*a* are shaped into a beveled facet 22*a*. With reference to this figure, as ink is consumed by writing, air bubbles arise at ink channel 12 and go up along duct pipe 2 and reach the end part of duct pipe 2 and duct pipe ink storage portion 2*a*, where the bubbles are released to the ink tank. Since the presence of beveled facet 22*a* makes air bubbles readily separate from the end part of the duct pipe and duct pipe ink storage portion 2*a*, it is possible to prevent adverse effects on the writing performance due to air bubbles failing to separate and remaining inside duct pipe 2. Although not shown, it is understood that the same effect can be expected by beveling the duct pipe in each of the other configurations.

As has been described heretofore, the present invention is configured as above. That is, if the volume of the ink tank is the same, it is possible to provide a direct-feed type writing implement using a smaller ink collector than that used in the conventional configuration. If an ink collector of the same size is used, it is possible to provide a direct-feed type writing implement capable of holding a greater amount of ink. Use of an ink collector smaller than the conventional configuration makes the appearance of the writing implement stylish. Further, the present invention has the advantages of low cost for forming and ease of forming over and above the conventional configuration.

As has been described heretofore, the entire ink tank can be filled up with ink. Further it is possible to provide a direct-feed type writing implement using an ink collector instead of a valve type, which provides easy writing for writers with a light touch and effectively prevents the problems of ink blow-out and the like.

Moreover, the conventional configuration cannot be applied as is to a direct-feed type writing implement since problems such as forward leakage occur. In contrast, the present invention can be applied to a direct-feed type writing implement by introducing a new mechanism.

Finally, since the present invention is not a valve type which needs extra springs or the like, it is possible to reduce the number of parts. As a result, it is possible to provide a writing implement which is low cost.

What is claimed is:

1. A direct-feed type writing implement comprising:

a point assembly having a writing point at the tip thereof;

an ink tank directly storing a relatively low viscosity ink having a viscosity of 2 to 100 mPa·S at room temperature;

an ink collector for adjusting the internal pressure in the ink tank by utilizing capillarity;

a feeder means including a center core, for feeding the ink from the ink tank to the writing point; and a duct pipe connecting the ink collector and the ink tank, characterized in that the ink is supplied to the center core as the ink feeder means only through the duct pipe.

2. The direct-feed type writing implement according to claim 1, wherein an end part of the duct pipe is located approximately at a midpoint of the ink tank or closer to a bottom of the ink tank than the midpoint.

3. The direct-feed type writing implement according to claim 1, wherein the ink collector is provided with an ink channel forming an air-liquid exchanger, and an ink feeder portion for leading the ink to the ink channel is formed on an end face of the ink collector on the ink tank side.

4. The direct-feed type writing implement according to claim 1, wherein a fine hole is formed in a communication passage for creating communication between the ink collector for adjusting the internal pressure in the ink tank by utilizing capillarity.

5. The direct-feed type writing implement according to claim 1, wherein, when the level of ink is above a duct pipe end portion with the writing point set downwards, the expansion of an air space when the temperature of the ink tank is increased from room temperature to about 500 C, is equal to or lower than a ink retention volume of the ink collector.

6. The direct-feed type writing implement according to claim 1, wherein, when the level of ink is above a duct pipe end portion with the writing point set upwards, the expansion of a air space when the temperature of the ink tank is increased from room temperature to about 500 C., is equal to or lower than the sum of an ink retention volume of the ink collector and a volume of the clearance formed between a barrel wall of the writing implement and the ink collector.

7. The direct-feed type writing implement according to claim 1, wherein, when the duct pipe is formed with an duct pipe ink storage portion and when the duct pipe is formed with the ink storage portion and an ink pool, the total volume including a retention volume of the duct pipe, the duct pipe ink storage portion and the ink pool, is equal to or smaller than a retention volume of the ink collector.

8. The direct-feed type writing implement according to claim 1, wherein the ink tank is charged with the ink until almost full.

9. The direct-feed type writing implement according to claim 1, wherein an end portion of the duct pipe is shaped into a beveled configuration.

10. A direct-feed type writing implement comprising:

a point assembly having a writing point at the tip thereof;

an ink tank directly storing a relatively low viscosity ink having a viscosity of 2 to 100 mPa·S at room temperature;

an ink collector for adjusting the internal pressure in the ink tank by utilizing capillarity;

a feeder means including a center core, for feeding the ink from the ink tank to the writing point;

a duct pipe connecting the ink collector and the ink tank; and a duct pipe ink storage portion provided for the duct pipe, characterized in that the ink is supplied to the center core as the ink feeder means only through the duct pipe.

11. The direct-feed type writing implement according to claim 10, wherein the duct pipe ink storage portion provided for the duct pipe is located near an end part of the ink tank.

12. The direct-feed type writing implement according to claim 10, wherein the duct pipe ink storage portion provided for the duct pipe is located close to an interior wall of the ink tank.

13. The direct-feed type writing implement according to claim 10, wherein an end portion of the duct pipe and the duct pipe ink storage portion are shaped into a beveled configuration.

14. The direct-feed type writing implement according to claim 10, wherein the duct pipe ink storage portion is shaped into a beveled configuration.

15. The direct-feed type writing implement according to claim 10, wherein an end part of the duct pipe or an end of the duct pipe ink storage portion is located approximately at a midpoint of the ink tank or closer to a bottom of the ink tank than the midpoint.

16. The direct-feed type writing implement according to claim 10, wherein the ink collector is provided with an ink channel forming an air-liquid exchanger, and an ink feeder portion for leading the ink to the ink channel is formed on an end face of the ink collector on the ink tank side.

17. The direct-feed type writing implement according to claim 10, wherein a fine hole is formed in a communication passage for creating communication between the ink collector for adjusting the internal pressure in the ink tank by utilizing capillarity.

18. The direct-feed type writing implement according to claim 10, wherein, when the level of ink is above a duct pipe end portion or an end of the duct pipe ink storage portion with the writing point set downwards, the expansion of an air space when the temperature of the ink tank is increased from room temperature to about 500 C, is equal to or lower than an ink retention volume of the ink collector.

19. The direct-feed type writing implement according to claim 10, wherein, when the level of ink is above a duct pipe end portion or an end of the duct pipe ink storage portion with the writing point set upwards, the expansion of an air space when the temperature of the ink tank is increased from room temperature to about 500 C, is equal to or lower than the sum of an ink retention volume of the ink collector and a volume of the clearance formed between a barrel wall of the writing implement and the ink collector.

20. The direct-feed type writing implement according to claim 10, wherein, when the duct pipe is formed with the duct pipe ink storage portion and when the duct pipe is formed with the ink storage portion and an ink pool, the total volume including a retention volume of the duct pipe, the duct pipe ink storage portion and the ink pool, is equal to or smaller than a retention volume of the ink collector.

21. The direct-feed type writing implement according to claim 10, wherein the ink tank is charged with the ink until almost full.

22. A direct-feed type writing implement comprising:

a point assembly having a writing point at the tip thereof;

an ink tank directly storing a relatively low viscosity ink having a viscosity of 2 to 100 mPa·S at room temperature;

an ink collector for adjusting the internal pressure in the ink tank by utilizing capillarity;

a feeder means including a center core, for feeding the ink from the ink tank to the writing point; and a duct pipe connecting the ink collector and the ink tank, characterized in that the duct pipe has a duct pipe ink storage portion at a position close to the ink tank end and an inner wall of the ink tank, an end of the duct pipe ink storage portion is located approximately at a midpoint of the ink tank or closer to a bottom of the ink tank than the midpoint, and the ink is supplied to the center core as the ink feeder means only through the duct pipe.

* * * * *